US010269276B2

(12) United States Patent
Kwon et al.

(10) Patent No.: US 10,269,276 B2
(45) Date of Patent: Apr. 23, 2019

(54) TIMING CONTROLLER AND DISPLAY DEVICE INCLUDING THE SAME

(71) Applicant: LG DISPLAY CO., LTD., Seoul (KR)

(72) Inventors: KyungJoon Kwon, Paju-si (KR); SeongGyun Kim, Anyang-si (KR); Cheon Heo, Paju-si (KR); ByeongHyeon Na, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 176 days.

(21) Appl. No.: 15/377,603

(22) Filed: Dec. 13, 2016

(65) Prior Publication Data

US 2018/0061290 A1 Mar. 1, 2018

(30) Foreign Application Priority Data

Aug. 31, 2016 (KR) ..... 10-2016-0112085

(51) Int. Cl.
*G09G 3/00* (2006.01)
*G09G 3/20* (2006.01)

(52) U.S. Cl.
CPC ..... *G09G 3/006* (2013.01); *G09G 3/2003* (2013.01); *G09G 3/2044* (2013.01); *G09G 3/2059* (2013.01); *G09G 3/2092* (2013.01); *G09G 2310/027* (2013.01); *G09G 2310/08* (2013.01); *G09G 2340/0428* (2013.01); *G09G 2370/08* (2013.01)

(58) Field of Classification Search
CPC .... G09G 3/006; G09G 3/2003; G09G 3/2044; G09G 3/2059; G09G 3/2092
See application file for complete search history.

(56) References Cited

U.S. PATENT DOCUMENTS 6,069,609 A * 5/2000 Ishida ..... G09G 3/2022 345/596
2003/0063100 A1* 4/2003 Wang ..... H04N 19/184 345/596
2003/0202000 A1 10/2003 Kudo et al.
2005/0068344 A1 3/2005 Kurumisawa
2005/0237340 A1 10/2005 Ueno et al.
2007/0217559 A1* 9/2007 Stott ..... G11C 7/1051 375/355
2009/0021462 A1* 1/2009 Furihata ..... G09G 3/2011 345/89

(Continued)

FOREIGN PATENT DOCUMENTS

CN 105554351 A 5/2016
JP 2003-316334 A 11/2003
JP 2005-84516 A 3/2005

*Primary Examiner* — Carolyn R Edwards
(74) *Attorney, Agent, or Firm* — Birch, Stewart, Kolasch & Birch, LLP

(57) ABSTRACT

Provided are a timing controller and a display device including the same. The timing controller in one embodiment includes a bit selecting unit, an error calculating unit, and a dithering unit. The bit selecting unit is configured to fix an m bit data value of n+m bit input image data for a plurality of subpixels as a fixed data value, where n and m are integers. The error calculating unit is configured to calculate an error between the fixed data value fixed by the bit selecting unit and the m bit data value of the input image data before fixed by the bit selecting unit. The dithering unit is configured to generate n bit output image data dithered to correct the error.

15 Claims, 8 Drawing Sheets

(56) References Cited

U.S. PATENT DOCUMENTS

| | | | | |
|---|---|---|---|---|
| 2009/0128586 | A1 | 5/2009 | Ahn et al. | |
| 2013/0249969 | A1* | 9/2013 | Jeon | G09G 5/10 345/691 |
| 2014/0160146 | A1* | 6/2014 | Barnhoefer | G06T 11/001 345/598 |

* cited by examiner

| | R1 | R2 | R3 | R4 |
|---|---|---|---|---|
| Gray | 128.00 | 128.25 | 128.25 | 128.50 |
| Real 10 bit Data | 1000000000 | 1000000001 | 1000000001 | 1000000010 |
| 8 bit Data | 10000000 | 10000000 | 10000000 | 10000000 |
| LSB 2 bit Data | 00 | 01 | 01 | 10 |
| PC | 01 | 01 | 01 | 01 |
| Error Data | −01 | 00 | 00 | 01 |

| | |
|---|---|
| 127 | 128 |
| 128 | 128 |

R1

| | |
|---|---|
| 128 | 128 |
| 128 | 128 |

R2

| | |
|---|---|
| 128 | 128 |
| 128 | 128 |

R3

| | |
|---|---|
| 129 | 128 |
| 128 | 128 |

R4

FIG. 4

TIMING CONTROLLER AND DISPLAY DEVICE INCLUDING THE SAME

CROSS-REFERENCE TO RELATED APPLICATIONS

This application claims the priority of Korean Patent Application No. 10-2016-0112085 filed on Aug. 31, 2016, in the Korean Intellectual Property Office, the disclosure of which is incorporated herein by reference.

BACKGROUND

Field

The present disclosure relates to a timing controller and a display device including the same, and more particularly, to a timing controller and a display device including the same, which can provide an excellent image quality.

Description of the Related Art

With the development of the information society, requirements for display devices for displaying images have been increased in various forms and in recent years. Various display devices such as a liquid crystal display device, a plasma display device, an organic light emitting display device, and the like have been utilized.

The display device generally includes a display panel in which data lines and gate lines are formed and subpixels disposed at points where the data lines and the gate lines cross each other are provided, a data driving integrated circuit supplying data voltage to the data lines, a gate driving integrated circuit supplying scan voltage to the gate lines, a timing controller controlling the data driving integrated circuit and the gate driving integrated circuit, and the like.

In the display device, the data driving integrated circuit receives image data configured by predetermined bits from the timing controller and converts the received image data into data voltage corresponding to analog voltage and provides the data voltage to a corresponding subpixel.

In this case, when the number of bits of the image data increases, a color depth expressed in the corresponding subpixel increases to thereby enhancing an image quality. In order to implement a high-quality color depth, that is, in order to implement a color depth of a large number of bits, the number of processable bits of the data driving integrated circuit also needs to be the number of bits corresponding to a desired color depth. For example, in order to implement a high-quality color depth having a 1024 gray, the number of processable bits of the data driving integrated circuit needs to be 10 bits. Accordingly, in order to implement an excellent color depth, sizes of internal components of the data driving integrated circuit have to increase, and as a result, the size of the data driving integrated circuit itself has increased.

Further, since the data driving integrated circuit needs to receive the image data as large as the number of bits corresponding to the desired color depth from the timing controller, there is also a problem in that a data transfer quantity between the timing controller and the data driving integrated circuit has increased.

SUMMARY

An object of the present disclosure is to provide a timing controller which can implement image data having a larger number of bits by using a data driving integrated circuit having the small number of processable bits to reduce a data transfer quantity and the size of a data integrated circuit while providing a high image quality and a display device including the same.

Further, another object of the present disclosure is to provide a timing controller which can implement an image having a color which is substantially the same as a color implemented by image data having the large number of bits by correcting an error which occurs by fixing specific bit data value of the image data in the course of processing the image data having the large number of bits and a display device including the same.

The objects of the present disclosure are not limited to the aforementioned objects, and other objects, which are not mentioned above, will be apparent to a person having ordinary skill in the art from the following description.

According to an aspect of the present disclosure, there is provided a timing controller including a bit selecting unit, an error calculating unit, and a dithering unit. The bit selecting unit is configured to fix an m bit data value of n+m bit input image data for a plurality of subpixels as a fixed data value, where n and m are integers. The error calculating unit is configured to calculate an error between the fixed data value fixed by the bit selecting unit and the m bit data value of the input image data before fixed by the bit selecting unit. The dithering unit is configured to output n bit output image data dithered to correct the error. Since the timing controller according to the embodiment includes the error calculating unit and the dithering unit, even though the m bit data value of the input image data is fixed as the fixed data value, the resulting error may be corrected and the dithered output image data may accurately express a color depth corresponding to input image data.

According to another aspect of the present disclosure, provided is a display device including a display panel, a data driving integrated circuit, and a timing controller. The display panel includes a plurality of subpixels. The data driving integrated circuit is connected with the plurality of subpixels. The timing controller is configured to transmit output image data to the data driving integrated circuit. The timing controller includes a bit selecting unit configured to fix a specific bit data value of input image data for the plurality of subpixels as a fixed data value, an error calculating unit configured to calculate an error by comparing the fixed data value fixed by the bit selecting unit and the specific bit data value of the input image data before fixed by the bit selecting unit with each other, and a dithering unit configured to generate the output image data dithered to correct the calculated error. The data driving integrated circuit includes a latch unit storing the output image data, a digital analogue converter (DAC) configured to convert the output image data into analogue voltage, and a fixed voltage output unit configured to convert the fixed data value fixed by the bit selecting unit into the analogue voltage and transfer the analogue voltage to each of the plurality of subpixels.

Other detailed contents of the embodiments are included in the detailed description and the drawings.

According to the present disclosure, a color depth having n+m bit image data is implemented by n bit image data having a smaller bit number than n+m bits to reduce a data transfer quantity between a timing controller and a data driving integrated circuit and reduce the size of the data driving integrated circuit.

Further, according to the present disclosure, even though an error occurs in the course of fixing a specific m bit data value of the n+m bit image data, the error is calculated and the calculated error is corrected to implement an image having substantially the same color depth as an implemented by the n+m bit image data by the n bit image data.

The effect according to the present disclosure is not limited to the above described contents and more various effects are included in the present specification.

BRIEF DESCRIPTION OF THE DRAWINGS

The above and other aspects, features and other advantages of the present disclosure will be more clearly understood from the following detailed description taken in conjunction with the accompanying drawings, in which:

FIG. 4 is an exemplary diagram for describing an error correcting method of a dithering unit of FIG. 3;

DETAILED DESCRIPTION OF THE EMBODIMENTS

Figure 1:
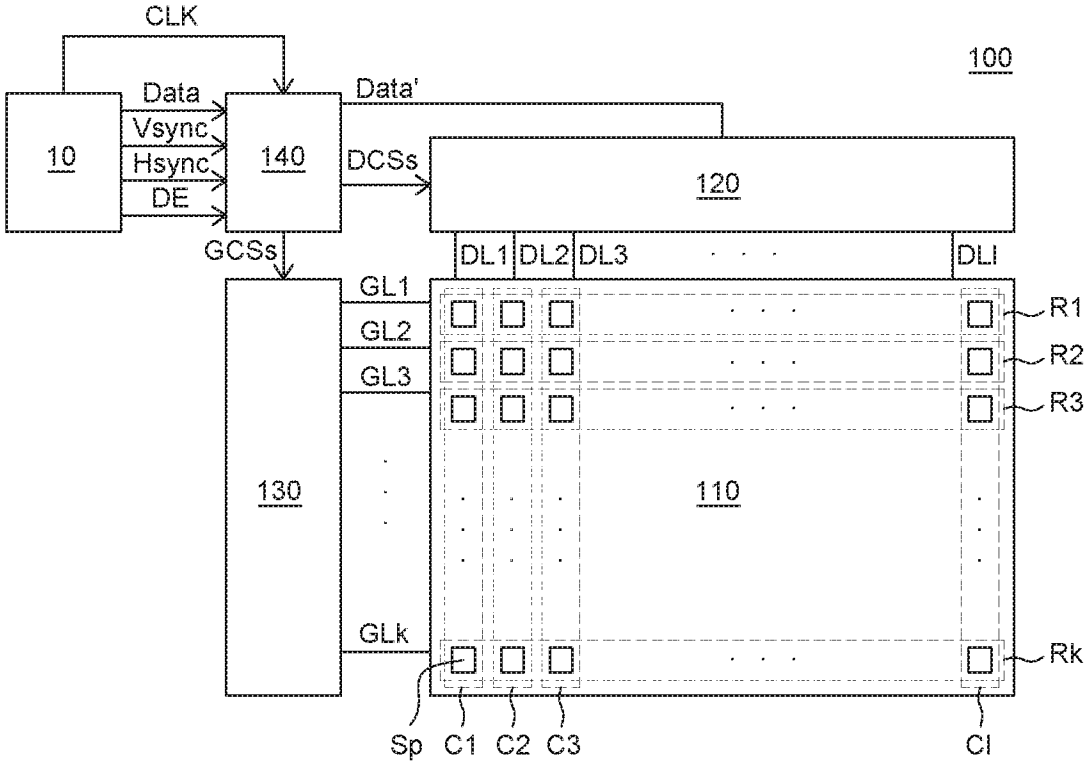
FIG. 1 is a schematic block diagram of a display device according to an embodiment of the present disclosure.

The advantages and features of the present disclosure, and a method of accomplishing these will become obvious with reference to embodiments to be described below in detail along with the accompanying drawings. However, the present disclosure is not limited to the embodiments set forth below, and may be embodied in various different forms. The present embodiments are just for rendering the description of the present disclosure complete and are set forth to provide a complete understanding of the scope of the disclosure to a person with ordinary skill in the technical field to which the present disclosure pertains, and the present disclosure will only be defined by the scope of the claims.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in the following description, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or higher parts may be positioned between the two parts unless the terms are used with the term "immediately" or "directly" is not used.

When an element or layer is referred to as being "on" another element or layer, it may be directly on the other element or layer, or intervening elements or layers may be present.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Throughout the whole specification, the same reference numerals denote the same elements generally.

Since size and thickness of each component illustrated in the drawings are represented for convenience in explanation, the present disclosure is not necessarily limited to the illustrated size and thickness of each component.

The features of various embodiments of the present disclosure can be partially or entirely bonded to or combined with each other and can be interlocked and operated in technically various ways as can be fully understood by a person having ordinary skill in the art, and the embodiments can be carried out independently of or in association with each other.

Hereinafter, various embodiments of the present disclosure will be described in detail with reference to the accompanying drawings.

FIG. 1 is a schematic block diagram of a display device according to an embodiment of the present disclosure. All the components of the display device according to all embodiments of the present disclosure are operatively coupled and configured.

Referring to FIG. 1, the display device 100 includes a display panel 110, a data driving integrated circuit 120, a gate driving integrated circuit 130, and a timing controller 140.

The display panel 110 includes a plurality of subpixels SP. The plurality of subpixels SP is arrayed in a row direction and a column direction to be disposed in matrix. For example, as illustrated in FIG. 1, the plurality of subpixels SP may be arrayed by k rows and 1 columns. A group of the subpixels SP arrayed in the row direction among the plurality of subpixels SP is defined as row subpixels R1 to Rk and a group of the subpixels SP arrayed in the column direction is defined as column subpixels C1 to C1.

Each of the plurality of subpixels SP implements light having a specific color. For example, the plurality of subpixels SP may be constituted by red subpixels implementing a red, green subpixels implementing a green, and blue subpixels implementing a blue. In this case, a group of the red subpixels, the green subpixels, and the blue subpixels may be referred to as one pixel.

The plurality of subpixels SP of the display panel 110 is connected with gate lines GL1 to GLk and data lines DL1 to DL1, respectively, where k and 1 are integers. For example, a first row subpixel R1 is connected to a first gate line GL1 and a first column subpixel C1 is connected to a first data line DL1. Similarly, second to k-th row subpixels R2 to Rk are connected with second to k-th gate lines GL2 to GLk, respectively and second to k-th column subpixels C2 to C1 are connected with second to 1-th gate lines DL2 to DL1, respectively. The plurality of subpixels SP is configured to operate based on gate voltage transferred from the gate lines GL1 to GLk and data voltage transferred from the data lines DL1 to DL1.

The timing controller 140 supplies various control signals DCS and GCS to the data driving integrated circuit 120 and the gate driving integrated circuit 130 to control the data driving integrated circuit 120 and the gate driving integrated circuit 130.

The timing controller 140 starts scanning according to a timing implemented in each frame, converts image data Data received from an external host system 10 according to a data signal format which may be processed by the data driving integrated circuit 120 to output image data Data', and controls data driving at an appropriate time according to the scanning.

The timing controller 140 fixes a data value corresponding to a specific bit of the input image data Data received from the external host system 10 as a fixed data value to generate pseudo control data. The timing controller 140 outputs the pseudo control data to the data driving integrated circuit 120 together with the output image data Data'. A detailed process in which the fixed data value is determined through the timing controller 140 will be described below.

Further, the timing controller 140 receives, from the external host system 10, various timing signals including a vertical synchronization signal Vsync, a horizontal synchronization signal Hsync, a data enable signal DE, a clock signal CLK, and the like together with the input image data.

The timing controller 140 generates various control signals DCS and GCS and outputs the control signals DCS and GCS to the data driving integrated circuit 120 and the gate driving integrated circuit 130 by receiving the timing signals including the vertical synchronization signal Vsync, the horizontal synchronization signal Hsync, the data enable signal DE, the clock signal CLK, and the like in order to control the data driving integrated circuit 120 and the gate driving integrated circuit 130 in addition to receiving the input image data Data from the host system 10 and converting the received image data Data according to the data signal format which may be processed by the data driving integrated circuit 120 to output the output image Data'.

For example, the timing controller 140 outputs various gate control signals GCSs including a gate start pulse (GSP), a gate shift clock (GSC), a gate output enable (GOE) signal, and the like in order to control the gate driving integrated circuit 130.

Herein, the gate start pulse controls an operation start timing of one or more gate circuits constituting the gate driving integrated circuit 130. The gate shift clock as a clock signal commonly input in one or more gate circuits controls a shift timing of a scan signal (gate pulse). The gate output enable signal designates timing information of one or more gate circuits.

Further, the timing controller 140 outputs various data control signals DCSs including a source start pulse (SSP), a source sampling clock (SSC), a source output enable (SOE) signal, and the like in order to control the data driving integrated circuit 120.

Herein, the source start pulse controls a data sampling start timing of one or more data circuits constituting the data driving integrated circuit 120. The source sampling clock is a clock signal controlling a sampling timing of data in each data circuit. The source output enable signal controls an output timing of the data driving integrated circuit 120.

The timing controller 140 may be disposed on a control printed circuit board connected with a source printed circuit board to which the data driving integrated circuit 120 is bonded through a connection medium such as a flexible flat cable (FFC) or a flexible printed circuit (FPC).

A power controller may be further disposed on the control printed circuit board, which supplies various voltage or current to the display panel 110, the data driving integrated circuit 120, the gate driving integrated circuit 130, and the like, and controls various voltage or current to be supplied. The power controller may be referred to as a power management IC (PMIC).

The source printed circuit board and the control printed circuit board may be configured as one printed circuit board.

The gate driving integrated circuit 130 sequentially supplies a scan signal of on voltage or off voltage according to the control of the timing controller 140 to the gate lines GL1 to GLk to sequentially drive the gate lines GL1 to GLk.

The gate driving integrated circuit 130 may be positioned only one side of the display panel 110 according to a driving method and in some cases, the gate driving integrated circuit 130 may be positioned at both sides of the display panel 110.

The gate driving integrated circuit 130 may be connected to a bonding pad of the display panel 110 by a tape automated bonding (TAB) method or a chip on glass (COG) method or is implemented by a gate in panel (GIP) type to be directly disposed on the display panel 110, and in some cases, may be integrated and disposed on the display panel 110.

The gate driving integrated circuit 130 includes a shift register, a level shifter, and the like.

When a specific gate line is opened, the data driving integrated circuit 120 converts the output image data Data' received from the timing controller 140 into analog type data voltage and supplies the analog type data voltage to the data lines DL1 to DL1 to drive the data lines DL1 to DL1.

The data driving integrated circuit 120 may be connected to the bonding pad of the display panel 110 by the tape automated bonding method or the chip on glass method or directly disposed on the display panel 110 and in some cases, the data driving integrated circuit 120 may be integrated and disposed on the display panel 110.

Further, the data driving integrated circuit 120 may be implemented by a chip on film (COF) method. In this case, one end of the data driving integrated circuit 120 is bonded to at least one source printed circuit board and the other end is bonded to the display panel 110.

The data driving integrated circuit 120 may include a logic unit including various circuits including a level shifter, a latch unit, and the like, a digital analog converter (DAC), an output buffer, and the like. Detailed contents thereof will be described below.

Figure 2:
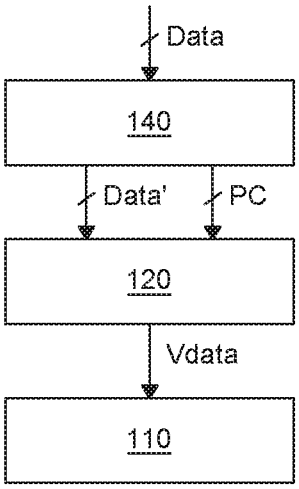
FIG. 2 is a schematic block diagram for describing a process in which image data of the display device is provided to a display panel according to the embodiment of the present disclosure.

FIG. 2 is a schematic block diagram for describing a process in which image data of the display device is provided to a display panel according to the embodiment of the present disclosure.

Referring to FIG. 2, the timing controller 140 receives the input image data Data from the external host system, converts the input image data Data to generate the output image data Data' so that the input image data Data is processed by the data driving integrated circuit 120, and generates pseudo control data PC corresponding to a specific bit of the input image data Data and transfers the generated pseudo control data PC to the data driving integrated circuit 120.

The input image data Data as high-quality image data includes information on an image having a high color depth. Herein, "color depth" may be referred to as expressiveness, resolution, luminance expressiveness, or gray expressiveness of a color. Since the input image data Data for an image in which the color depth is excellent includes a higher color depth, the input image data Data has a lot of information amount and has a large number of bits. In detail, the input image data Data may be n+m bits (for example, 10 bits and 12 bits).

The output image data Data' means a signal format data which may be processed by the data driving integrated circuit 120 and a smaller number of bits than the input image data Data received from the external host system 10. For example, the output image data Data' may be n bits, where n is an integer. Since the output image data Data' has a smaller number of bits than the input image data Data, the size of the data may be reduced and a data amount transmitted from the timing controller 140 to the data driving integrated circuit 120 may be reduced. Therefore, the data may be rapidly and efficiently transmitted between the timing controller 140 and the data driving integrated circuit 120.

The pseudo control data PC has the fixed data value selected by the timing controller 140. The pseudo control data PC is m bit data and corresponds to specific m bits of the input image data Data received from the external host system, where m is an integer. The pseudo control data PC is inserted into a control packet of a data packet transferred from the timing controller 140 to the data driving integrated circuit 120 to be transferred to the data driving integrated circuit 120.

The data driving integrated circuit 120 converts the output image data Data' and the pseudo control data PC received from the timing controller 140 into analog type data voltage Vdata and transfers the data voltage Vdata to the display panel 110. In detail, the data driving integrated circuit 120 receives n bit output image data Data' and m bit pseudo control data PC including image information and converts the received n bit output image data Data' and m bit pseudo control data PC into the analog type data voltage Vdata and provides the data voltage Vdata to the respective data lines DL1 to DL1 at a predetermined timing. Since the data voltage Vdata is generated based on n bit output image data Data' and m bit pseudo control data PC, the display panel 110 may finally display an image having an n+m bit color depth.

Figure 3:
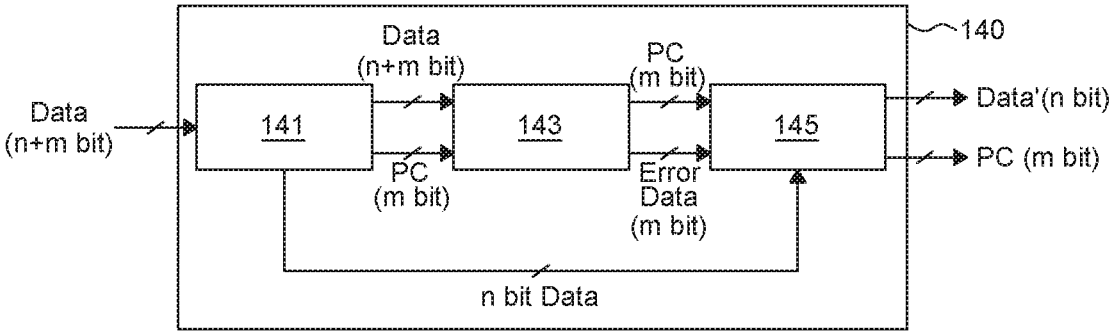
FIG. 3 is a schematic block diagram for describing a timing controller of the display device according to the embodiment of the present disclosure.

FIG. 3 is a schematic block diagram for describing a timing controller of the display device according to the embodiment of the present disclosure. Referring to FIG. 3, the timing controller 140 includes a bit selecting unit 141, an error calculating unit 143, and a dithering unit 145.

The bit selecting unit 141 is configured to fix a specific m bit data value of n+m bit input image data Data for a plurality of subpixels as the fixed data value. As mentioned above, the input image data Data is received from the external host system 10, includes gray information for each of the plurality of subpixels SP of the display panel 110, and is configure by n+m bits. The bit selecting unit 141 fixes a data value corresponding to specific m bits in the input image data Data for the plurality of subpixels as a specific fixed data value. Herein, the specific m bits may be a least significant bit (LSB) of the input image data Data for each of the plurality of subpixels SP. For example, when the input image data Data is configured by 10 bits and the LSB is configured by 2 bits, the bit selecting unit 141 does not fix 8 bit data value among 10 bit input image data Data and fixes a least significant 2 bit data value. In detail, when a data value of the input image data Data is 1000 0000 10, the bit selecting unit 141 does not fix 1000 0000 which is a data value of most significant 8 bits and fixes 10 which is a least significant 2 bit data value as the specific fixed data value. For example, when the data value of the input image data Data for a first subpixel is 1000 0000 10, the data value of the input image data Data for a second subpixel is 1000 0010 11, and the data value of the input image data for a third subpixel is 1110 0111 00, the bit selecting unit 141 may fix a least significant bit data value of the first subpixel, the second subpixel, and the third subpixel as 01. In this case, the input image data for the first subpixel is converted into 1000 0000 01, the input image data for the second subpixel is converted into 1000 001001, and the input image data for the third subpixel is converted into 1110 0111 01.

The bit selecting unit 141 analyzes a trend of the m bit data value of the input image data for the plurality of subpixels SP to determine the fixed data value. For example, the bit selecting unit 141 may determine a mode value, a mean value, or an intermediate value of the m bit data value of the input image data Data for the plurality of subpixels SP as the fixed data value of the input image data. In detail, when a least significant 2 bit data value of the input image data for a k-th row subpixel Rk arrayed in a k-th row is 01 01 01 00 10 11, the bit selecting unit 141 may determine 01 having a largest frequency as the fixed data value of the k-th row subpixel Rk. However, the present disclosure is not limited thereto and 10 which is the intermediate value of 01 01 01 00 10 11 may be determined as the fixed data value and 01 which is the mean value may be determined as the fixed data value.

In this case, the fixed data value for the k-th row subpixel arrayed in the same k-th row may be fixed as one same value. That is, when the fixed data value for the k-th row subpixel is determined as 01, the least significant 2 bit data value of the input image data Data for all k-th row subpixels arrayed in the k-th row is fixed as 01.

In this case, the bit selecting unit 141 may determine the fixed data value by not referring to the least significant 2 bit data value of all image data for the k-th row subpixel Rk arrayed in the k-th row but referring to only image data for some subpixels which are arbitrarily selected among the k-th row subpixels Rk. For example, the bit selecting unit 141 may determine the mode value, the intermediate value, or the mean value of the least significant 2 bit data value of the image data for initial 6 subpixels among the k-th row subpixels Rk arrayed in the k-th row as the fixed data value.

In some exemplary embodiments, the bit selecting unit 141 may determine the fixed data value for the image data for a (k+1)-th row subpixel arrayed in a (k+1)-th row based on the m bit data value of the image data for the k-th row subpixel Rk arrayed in the k-th row. For example, the bit selecting unit 141 may calculate the mode value, the intermediate value, or the mean value of the least significant 2 bit data value of the image data for initial 6 subpixels among the k-th row subpixels Rk arrayed in the k-th row as the fixed data value and determine the calculated value as the fixed data value of the image data for the (k+1)-th row subpixels arrayed in the (k+1)-th row. In this case, since the m bit data value for the image data for the (k+1)-th row subpixel need not be referred in order to determine the fixed data value for the (k+1)-th row subpixel, the fixed data value may be more smoothly and rapidly determined.

In some embodiments, the bit selecting unit 141 may be configured to not determine the fixed data value by referring the least significant 2 bit data value of the input image data for each row, but determine the fixed data values for a second row subpixel R2 arrayed in a second row and a third row subpixel R3 arrayed in a third row by rolling fixed data for the first row subpixel R1 arrayed in a first row. In detail, when it is assumed that the mode value of the least significant 2 bits of the image data Data for the first row subpixel R1 is 01, the bit selecting unit 141 may determine the fixed data value of the image data Data for the first row subpixel R1 as 01, determine the fixed data value of the image data Data for the second row subpixel R2 as 10, and determine the fixed data value of the image data Data for the third row subpixel R3 as 11. The bit selecting unit 141 may determine the fixed data value by rolling 00 01 10 11 so that 00 01 10 11 is repeated in all row subpixels with a uniform distribution. In this case, as the fixed data value for the first row subpixel is determined, the fixed data values for the residual row subpixels are autonomously determined, a process of determining the fixed data value may be rapidly and smoothly performed.

The error calculating unit 143 is configured to calculate an error between the fixed data value fixed by the bit selecting unit 141 and the m bit data value of the input image data Data before being fixed by the bit selecting unit 141. In detail, the error calculating unit 143 receives the pseudo control data PC from the bit selecting unit 141 and receives the input image data Data before being fixed. Since a data value of the pseudo control data PC preferably means the fixed data value, the error calculating unit 143 may know the fixed data value fixed by the bit selecting unit 141 through the pseudo control data PC.

The error calculating unit 143 is configured to calculate a difference value between the m bit data value of the input image data Data before being fixed by the bit selecting unit 141 and the fixed data value fixed by the bit selecting unit 141 as the error. For example, when the data value of the 10 bit input image data Data for the plurality of subpixels is 1000 0000 01 and the data value of the 2 bit pseudo control data PC is 00, the error calculating unit 143 calculates the difference value between 01 which is the least significant 2 bit data value of the 10 bit input image data Data and 00 which is the fixed data value of the pseudo control data PC. In this case, since 01-00=+01, the error calculated by the error calculating unit 143 becomes +01. The error calculating unit 143 outputs +01 which is the difference value between 01 which is the least significant 2 bit data value of the 10 bit input image data Data and 00 which is the fixed data value as error data.

The error data output by the error calculating unit 143 has a positive sign or a negative sign. For example, as described above, when the least significant 2 bit data value of the 10 bit input image data Data is 01 and the fixed data value is 00, since the error data is +01, the error data has the positive sign. However, when the least significant 2 bit data value of the 10 bit input image data Data is 01 and the fixed data value is 10, since the error data is −01, the error data has the negative sign.

The dithering unit 145 generates the output image data Data' dithered so as to correct the error calculated by the error calculating unit 143. In detail, the dithering unit 145 receives the error data from the error calculating unit 143 and receives n bit image data from the bit selecting unit 141. The n bit image data preferably means data acquired by excluding m bits from the n+m bit input image data Data and has the number of bits of n bits. For example, when the input image data Data received from the external host system 10 is 1000 0000 10, the n bit image data becomes 1000 0000 acquired by excluding 10 which is the least significant 2 bit data.

The dithering unit 145 dithers the n bit image data so that a color corresponding to the n+m bit input image data Data received from the external host system 10 is implemented as the n bit image data. In this case, the dithering unit 145 compensates the error calculated by the error calculating unit 143 in dithering the n bit image data. A dithering method by the dithering unit 145 will be described in more detail with reference to FIG. 4 together.

FIG. 4 is an exemplary diagram for describing an error correcting method of a dithering unit of FIG. 3. FIG. 4 illustrates an example in which the least significant 2 bit data is fixed in the 10 bit input image data. Further, it is assumed that an image expressed by the 10 bit input image data is a solid pattern image having a single color in which all of the red subpixel, the green subpixel, and the blue subpixel are driven with the same gray. It is assumed that the gray expressed by the 10 bit input image data is constituted by an integer part corresponding to a gray expressed by 8 bit image data and a decimal point part corresponding to a gray which may not be expressed by the 8 bit image data for easy description. That is, the gray which may be expressed by the 8 bit image data is 0 gray to 255 gray, and as a result, the integer part in the 10 bit input image data has values of 0 to 255 and the decimal point part in the 10 bit input image data has values of 0.00, 0.25, 0.50, and 0.75 corresponding to 00, 01, 10, and 11 which are the 2 bit (10 bit-8 bit) data values.

Referring to FIG. 4, the 10 bit input image data (real 10 bit data) received from the external host system is 1000 0000 00 and the least significant 2 bit data (LSB 2 bit data) is 00. The least significant 2 bit data (LSB 2 bit data) is fixed as 01 which is the fixed data value by the bit selecting unit 141. Therefore, the input image data Data is reduced to 8 bits and an image having the 10 bit color depth is expressed by using the 2 bit pseudo control data PC having 01 which is the fixed data value and the 8 bit image data having 1000 0000. However, in this case, the data 1000 0000 01 acquired by combining the 8 bit image data (8 bit Data) and the pseudo control data PC is larger than 1000 0000 00 which is the 10 bit input image data (Real 10 bit data) by 01 which is the least significant 2 bit data value. Accordingly, when the image is to be implemented based on 1000 0000 which is the 8 bit image data (8 bit Data) and 01 which is the pseudo control data PC, a difference of a gray corresponding to 01 which is the least significant 2 bits may occur as compared with the image based on 1000 0000 00 which is the 10 bit input image data (Real 10 bit Data). Therefore, 01 as the error which occurs by the pseudo control data PC needs to be removed in order to minimize the difference of the gray.

To this end, the error calculating unit 143 calculates the error between the least significant 2 bit data value (LSB 2 bit Data) of the 10 bit input image data (Real 10 bit Data) and the fixed data value of the pseudo control data PC. In detail, the error calculating unit 143 calculates the difference value between the least significant 2 bit data value (LSB 2 bit Data) of the 10 bit input image data (Real 10 bit Data) and the fixed data value of the pseudo control data PC to generate the error data. According to the aforementioned example, since the least significant 2 bit data value (LSB 2 bit Data) of the 10 bit input image data (Real 10 bit Data) is 00 and the fixed data value of the pseudo control data PC is 01, the error data becomes 00-01=−01.

The dithering unit 145 generates dithered n bit output image data Data' by reflecting the error data calculated by the error calculating unit 143 so as to compensate the error by the pseudo control data PC. In detail, the dithering unit 145 dithers the 8 bit image data so as to express the color corresponding to the 10 bit data acquired by coupling −01 which is the error data calculated by the error calculating unit 143 to 1000 0000 which is the 8 bit image data (8 bit Data) acquired by removing the least significant 2 bit data (LSB 2 bit Data) from the 10 bit input image data (Real 10 bit Data). In other words, the dithered 8 bit output image data Data' output by the dithering unit 145 expresses the color corresponding to 0111 1111 11 which is the 10 bit data and 0111 1111 11 which is the 10 bit data corresponds to the combination data of 1000 0000 which the 8 bit image data (8 bit Data) and −01 which is the error data. That is, 0111 1111 11 (10 bit)=1000 0000 (8 bit)+−01 (2 bit). Herein, 0111 1111 11 which is the 10 bit data means data different from the 10 bit input image data (Real 10 bit Data) received from the external host system 10 and means 10 bit data in which the error by the pseudo control data PC is corrected by applying the error data. For easy description, hereinafter, the 10 bit data will be referred to as "corrected 10 bit data".

The dithering unit 145 dithers the 8 bit image data so as to express the color corresponding to 0111 1111 11 which is the corrected 10 bit data as the 8 bit image data. The 8 bit image data may be dithered by a temporal or spatial method. FIG. 4 illustrates an example in which dithering is performed by the spatial method. The dithering by the spatial method expresses an intermediate color which may not be expressed as the 8 bit image data by mixing colors of 4 adjacent pixels. For example, in the case of a gray-color solid pattern image, the 8 bit image data may just express only a 127-gray gray color and a 128-gray gray color and not express 127.25, 127.50, and 127.75-gray gray colors. However, the 127.25, 127.50, and 127.75-gray gray colors may be expressed through the dithering. In detail, 0111 1111 11 which is the corrected 10 bit data corresponds to 127.75 gray. The dithering unit 145 expresses the 127.75 gray by controlling the gray for 4 adjacent pixels. That is, three pixels among four pixels are driven to express a 128-gray gray color and one pixel is driven to express a 127-gray gray color. In this case, four pixels may be viewed as the gray color of the 127.75 gray which is the mean value of 128+128+128+127.

Meanwhile, in the dithering by the temporal method, in order to express the 127.75-gray gray color, a ratio of a time when a specific pixel displays the 128-gray gray color and a time when the specific pixel displays the 127-gray gray color is controlled as 3:1. In this case, since the gray of the specific pixel is minutely changed within a short time, the specific pixel may be viewed by the 127.75-gray gray color.

As illustrated in FIG. 4, when the dithering unit 145 performs the dithering by the spatial dithering method, the dithering unit 145 generates the 8 bit output image data for 4 pixels so as to express the 127.75 gray corresponding to 0111 1111 11 which is the corrected 10 bit data. That is, the dithering unit 145 generates the 8 bit output image data Data' corresponding to each pixel so that three pixels among 4 pixels express the 128-gray gray color and one pixel expresses the 127-gray gray color.

Meanwhile, as mentioned above, 0111 1111 11 which is the 10 bit correction data means combination data of 1000 0000 which is the 8 bit data (8 bit Data) acquired by removing the least significant 2 bit data (LSB 2 bit Data) from 1000 0000 00 which is the 10 bit input image data (Real 10 bit Data) and −01 of the error data calculated by the error calculating unit 143. However, in general, since the dithering unit 145 may not dither the error data having the negative sign, the error data of −01 is switched into −0000 0001 (8 bit)+11 (2 bit) to be applied. That is, −1 is applied to the least significant 1 bit data value in the 8 bit image data (8 bit Data) and the error data is converted into +11, and as a result, the 10 bit correction data is generated and the 10 bit correction data is dithered. That is, the 10 bit correction data corresponds to 0111 1111 11 (10 bit)=0111 1111 (8 Bit)+11 (2 bit). The 8 bit image data dithered by the dithering unit 145 expresses the color corresponding to 0111 1111 11 which is the 10 bit correction data and the dithering unit 145 generates the 8 bit output image data Data' for each pixel so that three pixels among four pixels express the 128-gray gray color and one pixel expresses the 127-gray gray color.

Meanwhile, as mentioned above, the 8 bit output image data Data' dithered by the dithering unit 145 is compared with the 10 bit input image data (Real 10 bit Data) to have a difference corresponding to the error data. However, this is offset as the pseudo control data PC is applied and the color expressed by the display panel 110 is the same as the color expressed by the 10 bit input image data (Real 10 bit Data). For example, in the case of the first row subpixel R1 arrayed in the first row, the 8 bit output image data Data' dithered by the dithering unit 145 corresponds to the 127.75-gray gray color. That is, three pixels among four pixels are driven to express a 128-gray gray color and one pixel is driven to express a 127-gray gray color. However, since the fixed data value of the pseudo control data PC is 01, the data voltage Vdata corresponding to 0.25 gray may be supplemented while the pseudo control data PC is converted into analog voltage in the data driving integrated circuit 120. Accordingly, the data voltage Vdata output by the data driving integrated circuit 120 corresponds to the 128-gray gray color and the 128-gray gray color is the same as the color expressed by the 10 bit input image data (Real 10 bit Data). That is, the data driving integrated circuit 120 generates the data voltage Vdata while converting the 8 bit output image data Data' and the pseudo control data PC into the analog voltage and the data voltage Vdata corresponds to 1000 0000 00 which is the 10 bit image data acquired by combining the 8 bit output image data Data' and the pseudo control data PC. A process in which the data voltage Vdata is generated through the data driving integrated circuit 120 will be described below in detail with reference to FIG. 6.

In a similar method, the dithering unit 145 generates the output image data Data' for the second row subpixel R2 arrayed in the second row, the third row subpixel R3 arrayed in the third row, and the fourth row subpixel R4 arrayed in the fourth row. That is, the dithering unit 145 generates the dithered 8 bit output image data Data' so as to express the color corresponding to 1000 0000 00 which is the 10 bit correction data acquired by combining 1000 0000 which the 8 bit image data for the second row subpixel R2 and 00 which is the error data calculated by the error calculating unit 143. That is, the 8 bit output image data Data' for each of four pixels is generated so that all of four pixels express the 128-gray gray color. The dithered 8 bit image data Data' is transmitted to the data driving integrated circuit 120 together with the 2 bit pseudo control data PC and converted into the analog voltage to be provided to the display panel 110. In this case, since the 2 bit pseudo control data PC has the fixed data value of 01, the color corresponding to 1000 0000 01 is finally displayed by the dithered 8 bit output image data Data' and the pseudo control data PC. Further, the dithering unit 145 generates the dithered 8 bit output image data Data' for the third row subpixel R3 by reflecting 00 which is the error data and generates the dithered 8 bit output image data Data' for the fourth row subpixel R4 by reflecting 01 which is the error data.

Referring back to FIG. 3, the 8 bit output image data generated by the dithering unit 145 and the 2 bit pseudo control data PC are transmitted to the data driving integrated circuit 120. The pseudo control data PC may be transmitted while being inserted into the control packet of the data packet generated by the timing controller 140. This will be described in more detail with reference to FIG. 5 together.

Figure 5:
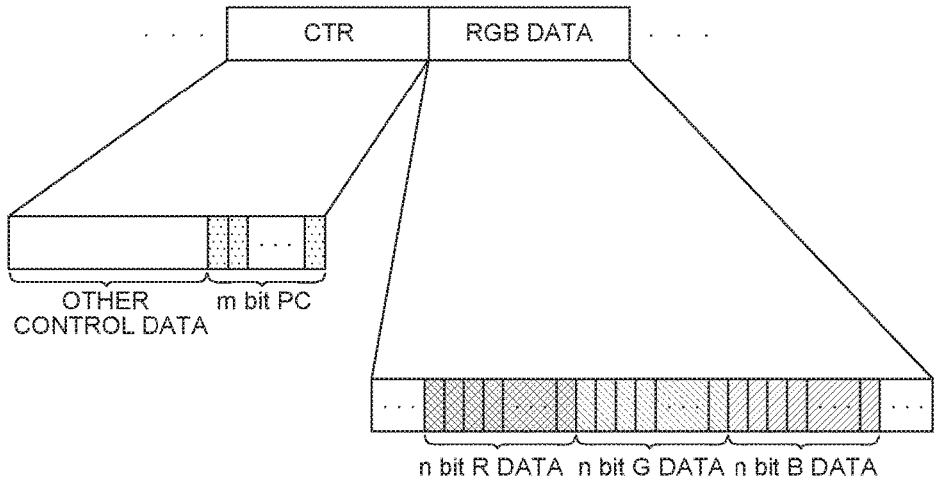
FIG. 5 is a schematic exemplary diagram of a data packet output from the timing controller of FIG. 3.

FIG. 5 is a schematic exemplary diagram of a data packet output from the timing controller of FIG. 3. Referring to FIG. 5, the data packet is constituted by a control packet CTR and RGB data RGB DATA. The RGB data RGB DATA includes 8 bit output image data n bit R DATA for the red subpixel, 8 bit output image data n bit G DATA for the green subpixel, and 8 bit output image data n bit B DATA for the blue suxpixel. In some embodiments, the RGB data RGB DATA may further include a 4 bit unit interval (UI) bit.

The control packet CTR includes the 2 bit pseudo control data PC commonly added to each of the 8 bit output image data n bit R DATA for the red subpixel, the 8 bit output image data n bit G DATA for the green subpixel, and the 8 bit output image data n bit B DATA for the blue subpixel.

The data driving integrated circuit 120 converts each of the RGB data RGB DATA of the data packet and the pseudo control data PC of the control packet CTR into the analog voltage and transfers the analog voltage to each data line. Therefore, the subpixels of the display panel 110 display the gray of the data voltage Vdata corresponding to the 10 bit data, and as a result, a 10 bit color depth is implemented as the 8 bit output image data. In particular, since the 2 bit pseudo control data PC is not included in the RGB data RGB DATA but is transmitted while being inserted into the control packet CTR for transferring various control signals to the data driving integrated circuit 120, the data transmission amount between the timing controller 140 and the data driving integrated circuit 120 may be maintained substantially similarly to the case of transmitting the 8 bit image data.

Figure 6:
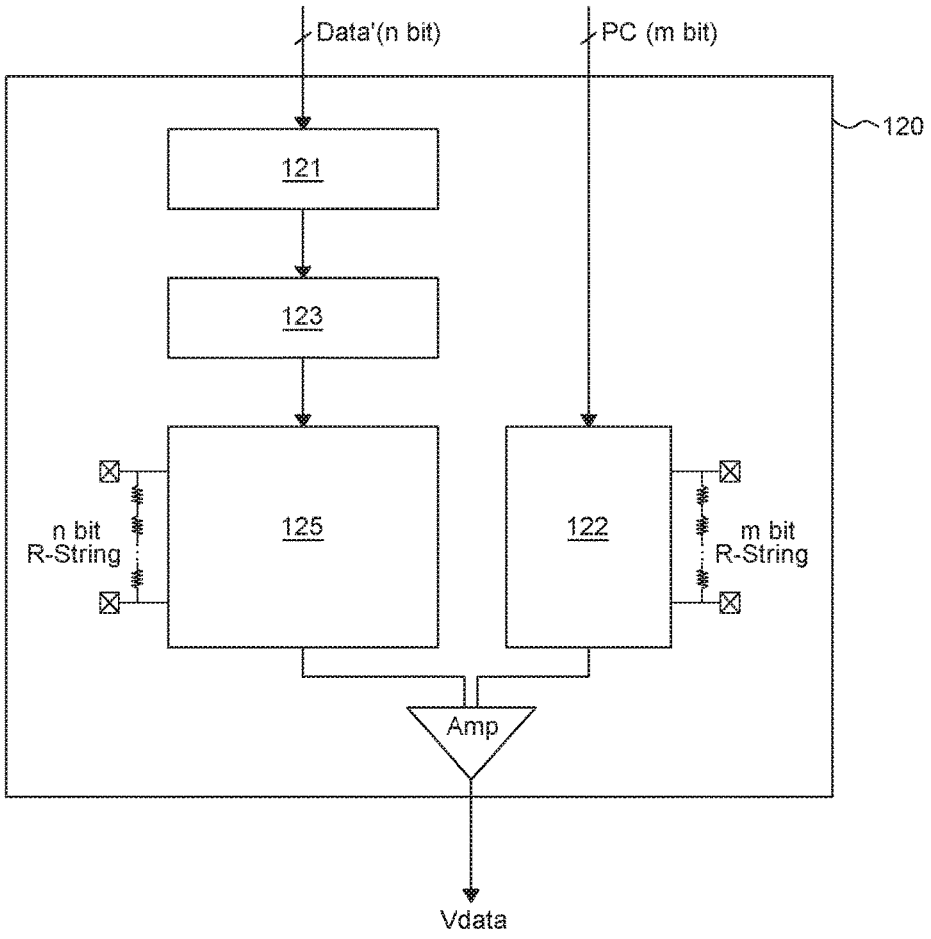
FIG. 6 is a schematic block diagram for describing a data driving integrated circuit of the display device according to the embodiment of the present disclosure.

FIG. 6 is a schematic block diagram for describing a data driving integrated circuit of the display device according to the embodiment of the present disclosure. Referring to FIG. 6, the data driving integrated circuit 120 includes a latch unit 121, a level shifter 123, a digital analogue converter (DAC) 125, and a fixed voltage output unit 122.

The latch unit 121 stores the output image data Data' dithered through the dithering unit 145 of the timing controller 140 and the level shifter 123 processes the dithered output image data Data'. As mentioned above, since the dithered output image data Data' includes the 8 bit output image data for each of the red subpixel, the green subpixel, and the blue subpixel, the latch unit 121 and the level shifter 123 are constituted by a 8 bit latch unit 121 and a 8 bit level shifter 123 corresponding to each of the red subpixel, the green subpixel, and the blue subpixel.

The digital analogue converter 125 is configured to convert the 8 bit output image data for each of the red subpixel, the green subpixel, and the blue subpixel processed by the latch unit 121 and the level shifter 123 into the analog voltage. The digital analogue converter 125 includes an 8 bit resistance string n bit R-String so as to generate gamma voltage corresponding to the data value of the 8 bit output image data.

The fixed voltage output unit 122 is configured to convert the fixed data value of the pseudo control data PC inserted into the control packet into the analog voltage. As mentioned above, the pseudo control data PC has the fixed data value selected by the timing controller 140 of the timing controller 140. When the pseudo control data PC has the bit number of 2 bits, the fixed voltage output unit 122 includes a 2 bit resistance string m bit R-String so as to convert 2 bit data into analog fixed voltage.

The gamma voltage generated through the digital analogue converter 125 and the fixed voltage generated through the fixed voltage output unit 122 are combined to be provided to the respective data lines DL1 to DL1 through an amplifier Amp and an output buffer as the data voltage Vdata. Since the plurality of subpixels SP of the display panel 110 are connected with the respective data lines DL1 to DL1, the plurality of subpixels SP emits light of the gray corresponding to the data voltage Vdata provided through the data lines DL1 to DL1.

As mentioned above, the display device 100 according to the embodiment of the present disclosure includes the timing controller 140 configured to generate the n bit output image data Data' and the m bit pseudo control data PC by processing the n+m bit input image data Data and the data driving integrated circuit generating the data voltage Vdata by converting the n bit output image data Data' and the m bit pseudo control data PC into the analog voltage. The m bit pseudo control data PC has the fixed data value selected by the bit selecting unit 141 of the timing controller 140 and is transmitted while being inserted into the control packet CTR of the data packet. Since the n bit output image data Data' has a smaller number of bits than the n+m bit input image data Data received from the external host system 10, the data amount transmitted by the timing controller 140 may be reduced as compared with a case of directly transmitting the n+m bit input image data Data.

In this case, the data amount processed by the data driving integrate circuit 120 may be reduced, as a result, the sizes of constitution circuits of the data driving integrated circuit 120 may be reduced. That is, the number of processible bits of the data driving integrated circuit 120 may be smaller than the n+m bit input image data Data received from the external host system 10. In detail, each of the latch unit 121, the level shifter 123, and the digital analogue converter 125 may be constituted by n bit circuits smaller than n+m bits and a total size of the data driving integrated circuit 120 may be reduced. Therefore, since the display device 100 may be miniaturized and a high-performance circuit need not be installed, manufacturing cost of the display device 100 may be reduced.

In particular, the bit selecting unit 141 of the timing controller 140 may select a specific subpixel among row subpixels arrayed in a specific row and select the fixed data value of the pseudo control data PC by referring to the m bit data value of the n+m bit input image data Data for the specific subpixel. In this case, since the n+m bit image data Data for all row subpixels arrayed in the specific row need not be referred, a line memory for storing the n+m bit image data Data for the low subpixels arrayed in the specific row may be omitted. Therefore, the size of the timing controller 140 may be further reduced.

Further, the timing controller 140 includes the dithering unit 145 that generates the dithered n bit output image data Data' so as to implement the color which may be implemented as the n+m bit input image data Data. Therefore, the color depth which may be implemented as the n+m bit input image data Data may be expressed through the n bit output image data Data' having a smaller number of bits than n+m bits. In particular, the timing controller 140 includes the error calculating unit 143 that generates the error data so as to correct the error by the pseudo control data PC during the dithering by the dithering unit 145. Since the pseudo control data PC has the fixed data value fixed by the bit selecting unit 141 of the timing controller 140, the error may occur in an m bit part as compared with the original n+m bit input image data Data received from the external host system 10. However, the display device 100 according to the embodiment of the present disclosure includes the error calculating unit 143 that calculates the error data by calculating the difference value between the m bit data value of the n+m bit input image data Data and the fixed data value of the pseudo control data PC and includes the dithering unit 145 that reflects the error data to the dithering. Therefore, the error by the pseudo control data PC may be corrected and the data voltage Vdata output through the data driving integrated circuit 120 may correspond to the n+m bit input image data Data received from the external host system 10. As a result, the error by the pseudo control data PC may be significantly reduced. The aforementioned error reduction effect will be described with reference to FIGS. 7 and 8.

Figure 7:
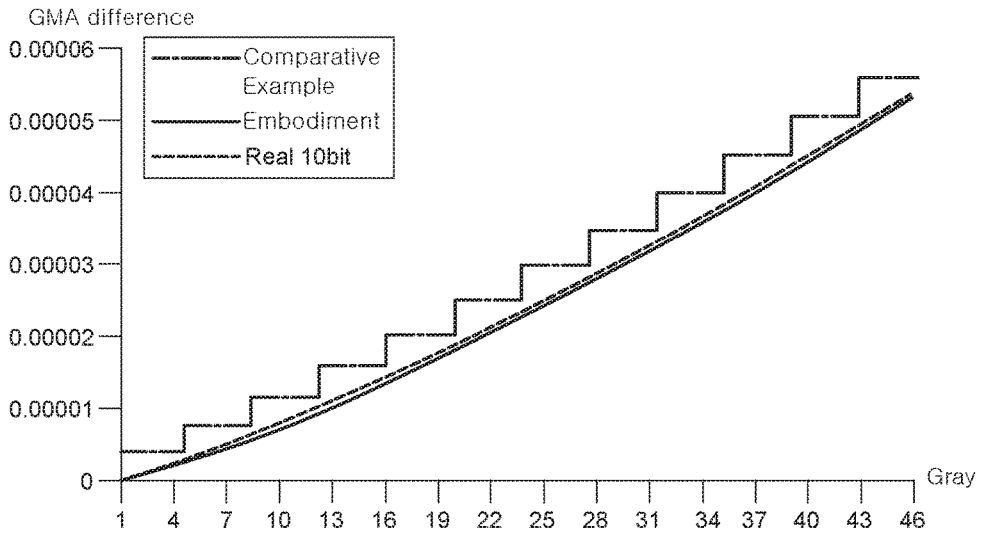
FIG. 7 is a graph showing a gray change rate depending on a gray of the display device according to the embodiment of the present disclosure.

FIG. 7 is a graph showing a gray change rate depending on a gray of the display device according to the embodiment of the present disclosure. In the graph of FIG. 7, all of the red subpixel, the green subpixel, and the blue subpixel are measured by using the 10 bit input image data having the single-color solid pattern. In the graph of FIG. 7, a horizontal axis represents the gray, a vertical axis represents a gray change rate (GMA difference), and the gray change rate (GMA difference) is defined by [Equation 1] given below.

$$GMA\ \text{difference}=\{G(n)-G(n-1)\}/G(\text{Max}) \qquad \text{[Equation 1]}$$

In [Equation 1] given above, G(n) means a luminance value in n gray and G(n−1) means a luminance value in n−1 gray. G(Max) means a luminance value in the maximum gray (e.g., 1023 gray). In the graph of FIG. 7, the 10 bit input image data is converted into the dithered 8 bit output image data and the 2 bit pseudo control data to be provided to the data driving integrated circuit having an 8 bit data processing capability. In FIG. 7, a comparative example means the gray change rate (GMA difference) in the display device including the timing controller which does not have the error calculating unit and an embodiment means the gray change rate (GMA difference) in the display device according to the embodiment of the present disclosure, which include the timing controller which has the error calculating unit. Meanwhile, Real 10 bit means the gray change rate (GMA difference) in the display device when the 10 bit image data is provided to the data driving integrated circuit having the 10 bit data processing capability without the dithering.

Referring to FIG. 7, it can be seen that the gray change rate (GMA difference) in the display device according to the embodiment of the present disclosure is substantially equivalent to the gray change rate (GMA difference) of the real 10 bit display device that displays the 10 bit input image data without the dithering. Contrary to this, it can be seen that the gray change rate (GMA difference) of the display device according to the comparative example, which does not have the error calculating unit is significantly different from the gray change rate (GMA difference) of the real 10 bit display device. Since the display device according to the comparative example does not calculate the error by the pseudo control data and does not apply the error data during the dithering, the dithered 8 bit output image data may be significantly different from the real 10 bit image data. Contrary to this, in the display device according to the embodiment of the present disclosure, since the error data calculated by the error calculating unit is applied during the dithering by the dithering unit, the error by the pseudo control data may be minimized.

Figure 8:
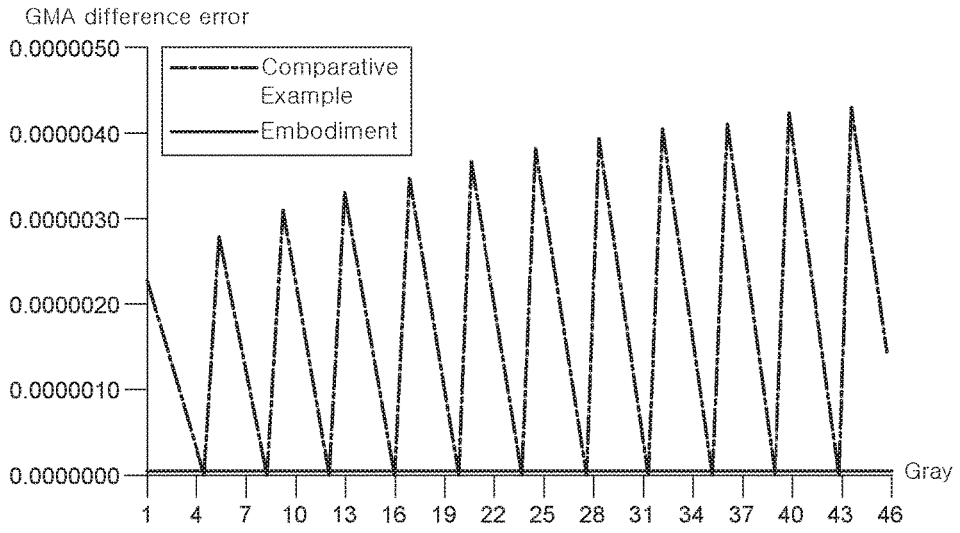
FIG. 8 is a graph showing an error of the gray change rate depending on the gray of the display device according to the embodiment of the present disclosure.

FIG. 8 is a graph showing an error of the gray change rate depending on the gray of the display device according to the embodiment of the present disclosure. The graph of FIG. 8 is measured under the same condition as the graph of FIG. 7 and in the graph of FIG. 8, the horizontal axis represents the gray and the vertical axis represents the error (GMA difference error) of the gray change rate defined by [Equation 2] given below.

$$GMA\ \text{difference error}=[\text{Real 10 bit}\ GMA\ \text{difference}-GMA\ \text{difference}] \qquad \text{[Equation 2]}$$

In [Equation 2] given above, Real 10 bit GMA difference means the gray change rate of the image which is implemented by directly providing the 10 bit input image data to the data driving integrated circuit having the 10 bit data processing capability without the dithering and GMA difference means the gray change rate of the image which is implemented by partitioning the 10 bit input image data into the dithered 8 bit output image data and the 2 bit pseudo control data and providing the partitioned dithered 8 bit output image data and 2 bit pseudo control data to the data driving integrated circuit having the 8 bit data processing capability. In FIG. 8, the comparative example means error of the gray change rate measured through the display device including the timing controller which does not have the error calculating unit and the embodiment means the error of the gray change rate measured through the display device according to the embodiment of the present disclosure, which include the timing controller which has the error calculating unit, similarly to FIG. 7.

Referring to FIG. 8, it can be seen that the error of the gray change rate significantly increases as the gray increases in the display device according to the comparative example and it can be seen that the error of the gray change rate does not almost occur in spite of a change of the gray in the display device according to the embodiment. In the display device according to the comparative example, since the error data is not reflected during the dithering, the error by the pseudo control data may significantly act as the gray value of the 10 bit input image data is changed. Contrary to this, in the display device according to the embodiment, since the error data is reflected during the dithering, the error by the pseudo control data is corrected even though the gray value of the 10 bit input image data is changed, the image having substantially the same color depth as the 10 bit input image data may be implemented.

Figure 9:
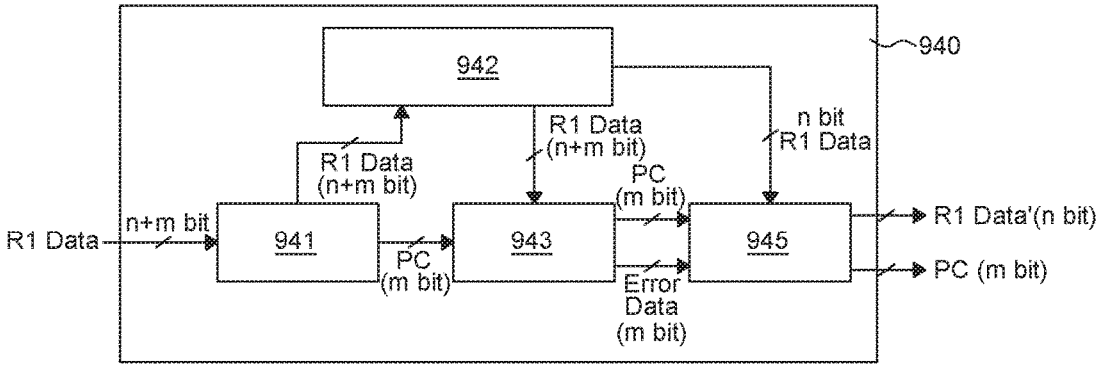
FIG. 9 is a schematic block diagram illustrating a timing controller of a display device according to another embodiment of the present disclosure.

FIG. 9 is a schematic block diagram illustrating a timing controller of a display device according to another embodiment of the present disclosure. The timing controller 940 of the display device according to another embodiment of the present disclosure is substantially the same as the timing controller 140 of the display device 100 according to the embodiment of the present disclosure except for further including a memory unit 942, and as a result, duplicated description thereof will be omitted.

Referring to FIG. 9, the memory unit 942 of the timing controller 940 stores n+m bit input image data R1 for a row subpixel arrayed in a specific row among n+m bit input image data received from the external host system. In detail, the memory unit 942 stores the input image data for the k-th row subpixel arrayed in the k-th row among the plurality of subpixels. Hereinafter, the timing controller 940 will be described by assuming a case of k=1 for easy description. That is, the memory unit 942 may be constituted by the line memory storing input image data R1 Data for a first row subpixel arrayed in a first row.

As mentioned above, a bit selecting unit 941 of the timing controller 940 determines fixed data values for the plurality of subpixels by referring to a data value of specific m bit of the n+m bit input image data for the plurality of subpixels. In this case, the fixed data value may be determined for each of the rows of the plurality of subpixels. In detail, the timing controller 940 receives the input image data R1 Data for the first row subpixel from the external host system and the bit selecting unit 941 determines the fixed data value by referring the specific m bit data value of the input image data R1 Data for the first row subpixel. In detail, the bit selecting unit 941 may calculate the mode value, the intermediate value, or the mean value of the least significant m bit data value of the input image data R1 Data for the first row subpixel and determine the calculated value as the fixed data value. For example, when the number of subpixels arrayed in the first row is 12 and the least significant 2 bit data values of the input image data R1 Data for the first row subpixel are 00, 01, 01, 00, 11, 01, 01, 00, 01, 11, 10, and 01, the bit selecting unit 941 may determine 01 which is the mode value of the least significant 2 bit data value of the input image data R1 Data for the first row subpixel as the fixed data value. The bit selecting unit 941 generates the pseudo control data PC having the fixed data value determined by the aforementioned method.

In some embodiments, the bit selecting unit 941 may determine a minimum error value in which the error from the m bit data value of the input image data R1 Data for the first row subpixel is minimized as the fixed data value. For example, when the least significant 2 bit data values of the input image data R1 Data for the first row subpixel are 00, 00, 00, 00, 01, 01, 01, 01, 10, 10, 10, and 10, the bit selecting unit 941 may determine 01 in which the difference value from the least significant 2 bit data values may be minimum as the fixed data value. In this case, since the error data calculated through the error calculating unit 943 become −01, −01, −01, −01, 00, 00, 00, 00, 01, 01, 01, and 01, when n bit output image data R1 Data' dithered by the dithering unit 945 is generated later, the error by the pseudo control data PC may be minimized.

Meanwhile, while the fixed data value is determined by the bit selecting unit 941, the n+m bit input image data R1 Data for the first row subpixel may be stored in the memory unit 942. For example, the bit selecting unit 941 may determine the fixed data value while receiving the n+m bit input image data R1 Data for the first row subpixel and the n+m bit input image data R1 Data for the first row subpixel may be stored in the memory unit 942 through the bit selecting unit 941.

The error calculating unit 943 generates the error data by calculating the difference value of the m bit data value of the input image data R1 Data for the first row subpixel stored in the memory unit 942 and the fixed data value of the pseudo control data PC generated by the bit selecting unit 941. For example, when the least significant 2 bit data values of the input image data R1 Data for the first row subpixel are 00, 01, 01, 00, 11, 01, 01, 00, 01, 11, 10, and 01 and the fixed data value of the pseudo control data PC is selected as the mode value 01 by the bit selecting unit 941, the error calculating unit 943 reads the m bit data value of the input image data R1 Data for the first row subpixel stored in the memory unit 942 and calculates the difference value from the fixed data value of the pseudo control data PC. In this case, the error data may be determined as −01, 00, 00, −01, +10, 00, 00, −01, 00, +10, +01, and 00.

The dithering unit 945 receives the error data from the error calculating unit 943 and receives the n bit image data (n bit R1 Data) for the first row subpixel from the memory unit 942. The n bit image data (n bit R1 Data) may be obtained by extracting n bit data acquired by excluding m bits from the n+m bit image data R1 Data for the first row subpixel stored in the memory unit 942. The dithering unit 945 generates the dithered n bit output image data R1 Data' by reflecting the error data to the n bit image data (n bit R1 Data). The n bit output image data R1 Data' generated by the dithering unit 945 is output to the data driving integrated circuit together with the pseudo control data PC.

After the n bit output image data R1 Data' and the pseudo control data PC for the first row subpixel are output, the n bit output image data for the second row subpixel and the pseudo control data may be generated and the n bit output image data for the third row sub pixel and the pseudo control data may be generated, in the similar method.

Figure 10:
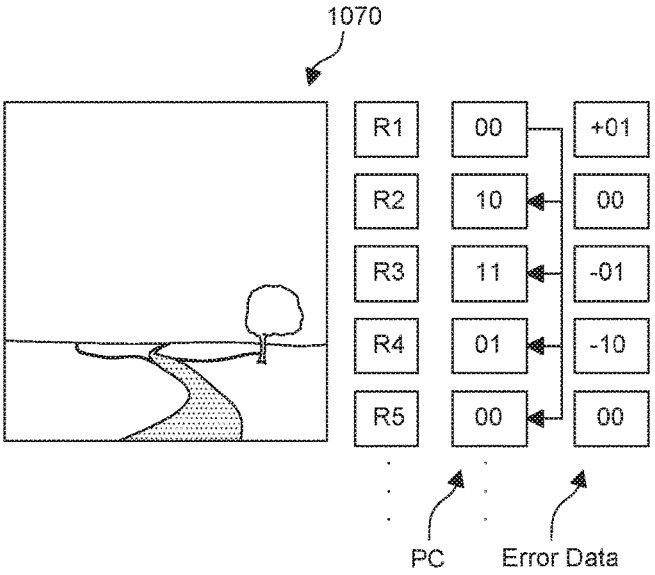
FIG. 10 is an exemplary diagram for describing a method for determining a fixed data value and an error correcting method of the timing controller of FIG. 9.

FIG. 10 is an exemplary diagram for describing a method for determining a fixed data value and an error correcting method of the timing controller of FIG. 9. Referring to FIG. 10, the determination of the fixed data value and the error correction by the timing controller 940 may be performed for each row.

For example, when a 10 bit image 1070 having a 10 bit color depth is displayed by the display device according to another embodiment of the present disclosure, the bit selecting unit 941 of the timing controller 940 receives the 10 bit input image data for the first row subpixel R1 and determines the fixed data value by referring to the trend of the least significant 2 bit data value of the 10 bit input image data for the first row subpixel R1. For example, the mode value 00 of the least significant 2 bit data value of the 10 bit input image data for the first row subpixel R1 may be determined as the fixed data value. 00 which is the fixed data value is output as the pseudo control data PC for the first row subpixel R1.

Meanwhile, while the fixed data value for the first row subpixel R1 is determined by the bit selecting unit 941 of the timing controller 940, the 10 bit input image data is stored in the memory unit 942 of the timing controller 940.

The error calculating unit 943 of the timing controller 940 compares the pseudo control data PC generated by the bit selecting unit 941 and the least significant 2 bit data value of the 10 bit input image data stored in the memory unit 941 to generate the error data. For example, the error calculating unit 943 calculates the difference value between the least significant 2 bit data value of the 10 bit input image data and the fixed data value of the pseudo control data PC for the first row subpixel R1 and generates the +01 which is the difference value as the error data.

The dithering unit 945 of the timing controller 940 generates the 8 bit output image data R1 Data' by reflecting the error data calculated by the error calculating unit 943. For example, the dithering unit 945 performs the dithering by reflecting the error data for the first row subpixel R1 and outputs the dithered 8 bit output image data R1 Data'. In this case, since the 8 bit output image data R1 Data' is data in which the error between the least significant 2 bit data of the 10 bit input image data and the pseudo control data PC is corrected, when the 8 bit output image data R1 Data' and the pseudo control data PC are combined with each other, the image having substantially the same color depth as the image 1070 by the 10 bit input image data may be implemented.

Thereafter, the 10 bit input image data for the second row subpixel R2 is received by the bit selecting unit 941 and the bit selecting unit 941 generates the pseudo control data PC for the second row subpixel R2. In this case, the 10 bit input image data for the second row subpixel R2 may be newly stored in the memory unit 942. When the generation of the pseudo control data PC is completed by the bit selecting unit 941, the error calculating unit 943 generates the error data by calculating the difference value of the least significant 2 bit data value of the 10 bit input image data for the second row subpixel R2 stored in the memory unit 942 and the fixed data value of the pseudo control data PC. When the generation of the error data for the second row subpixel is completed by the error calculating unit 943, the dithering unit 945 extracts 8 bit data from the 10 bit input image data for the second row subpixel R2 stored in the memory unit 942 and combines the 8 bit data and the error data, and generates the dithered 8 bit output image data. Since the error data calculated by the error calculating unit 943 is applied to the 8 bit output image data, an image implemented by the 8 bit output image data and the pseudo control data PC has substantially the same color depth as the image by the 10 bit input image data.

By the similar method, the 8 bit output image data and the pseudo control data PC for the third row subpixel R3, the 8 bit output image data and the pseudo control data PC for the fourth row subpixel R4, and the 8 bit output image data and the pseudo control data PC for the fifth row subpixel R5 are sequentially generated.

In some embodiments, the bit selecting unit 941 may determine the pseudo control data PC for the second row subpixel R2 based on the n+m bit input image data for the first row subpixel R1. For example, when the mode value of the least significant 2 bit data value of the 10 bit input image data for the first row subpixel R1 is 10, the bit selecting unit 941 may select 10 as the pseudo control data PC for the second row subpixel R2. In this case, since the bit selecting unit 941 need not determine the fixed data value for the second row subpixel R2, a use frequency of the bit selecting unit 941 may be reduced and a processing speed of the timing controller 940 may be further enhanced.

In some embodiments, the bit selecting unit 941 may generate the pseudo control data PC for the second row subpixel R2 to the fifth row subpixel R5 by a method of rolling the pseudo control data PC for the first row subpixel R1. For example, when the pseudo control data PC for the first row subpixel R1 is determined as 00, the pseudo control data PC for the second row subpixel R2 may be generated as 01, the pseudo control data PC for the third row subpixel R3 may be determined as 10, the pseudo control data PC for the fourth row subpixel R4 may be determined as 11, and the pseudo control data PC for the fifth row subpixel R5 may be determined as 00 again. In this case, when the pseudo control data PC for the first row subpixel R1 is determined, the pseudo control data PC for the second to fifth row subpixels R2 to R5 are automatically generated, and as a result, the use frequency of the bit selecting unit 941 may be reduced and the processing speed of the timing controller 940 may be further enhanced.

The timing controller 940 of the display device according to another embodiment of the present disclosure includes the memory unit 942 that stores input image data for row subpixels arrayed in a specific row. In this case, the bit selecting unit 941 may generate the pseudo control data PC by referring to all input image data for the row subpixels arrayed in the specific row and the error calculating unit 943 may generate the error data from the input image data and the pseudo control data PC for the row subpixels stored in the memory unit 942. That is, since the bit selecting unit 941 may determine the pseudo control data PC by referring to all of the input image data for the row subpixels, the pseudo control data PC to which the trend of the input image data for the row subpixels is reflected may be generated and the error by the pseudo control data PC may be more easily corrected. In particular, the bit selecting unit 941 may determine the minimum error value in which the error from the m bit data values of the image data for the row subpixels is minimized as the fixed data value. In this case, the error by the pseudo control data PC may be minimized and when the dithering unit 945 dithers the n bit output image data by reflecting the error data, the dithering may be more easily performed.

The timing controller and the display device including the same according to the embodiments of the present disclosure may be described as follows.

A timing controller according to an embodiment of the present disclosure includes a bit selecting unit, an error calculating unit, and a dithering unit. The bit selecting unit is configured to fix an m bit data value of n+m bit input image data for a plurality of subpixels as a fixed data value. The error calculating unit is configured to calculate an error between the fixed data value fixed by the bit selecting unit and the m bit data value of the input image data before fixed by the bit selecting unit. The dithering unit is configured to output n bit output image data dithered to correct the error. Since the timing controller according to the embodiment includes the error calculating unit and the dithering unit, even though the m bit data value of the image data is fixed as the fixed data value, the resulting error may be corrected and the dithered output image data may accurately express a color depth corresponding to original image data.

According to another feature of the present disclosure, the bit selecting unit may be configured to fix a least significant m bit data value of input image data for k-th row subpixels arrayed in a k-th row among the plurality of subpixels.

According to yet another feature, the timing controller may further include a memory unit configured to store the input image data for the k-th row subpixels arrayed in the k-th row. The bit selecting unit may be configured to determine as the fixed data value for the k-th row subpixels a mode value, an intermediate value, or a mean value of the m bit data value of the input image data for the k-th row subpixels stored in the memory unit.

According to still yet another feature of the present disclosure, the bit selecting unit may be configured to determine a minimum error value in which the error from the m bit data value of the input image data for the k-th row subpixel is minimized as the fixed data value for the k-th row subpixel.

According to still yet another feature of the present disclosure, the bit selecting unit may be configured to determine the fixed data value for the k-th row subpixel based on an m bit data value of input image data for a specific subpixel selected among the k-th row subpixels arrayed in the k-th row.

According to still yet another feature of the present disclosure, the bit selecting unit may be configured to determine the fixed data value for (k+1)-th row subpixels arrayed in a (k+1)-th row based on the m bit data value of the input image data for the k-th row subpixels arrayed in the k-th row.

According to still yet another feature of the present disclosure, the bit selecting unit may be configured to determine the fixed data value for the k-th row subpixels based on the m bit data values of the input image data for the k-th row subpixels arrayed in the k-th row and determine the fixed data value for the k+1-th row subpixels arrayed in the (k+1)-th row by rolling the fixed data value for the k-th row subpixels.

According to still yet another feature of the present disclosure, the error calculating unit may be configured to calculate a difference value between the m bit data value of the input image data before being fixed by the bit selecting unit and the fixed data value fixed by the bit selecting unit as the error.

According to still yet another feature of the present disclosure, the dithering unit may be configured to correct the n bit output image data so that the error has a positive value when the error has a negative value.

A display device according to an embodiment of the present disclosure includes a display panel, a data driving integrated circuit, and a timing controller. The display panel includes a plurality of subpixels. The data driving integrated circuit is connected with the plurality of subpixels. The timing controller is configured to transmit output image data to the data driving integrated circuit. The timing controller includes a bit selecting unit configured to fix a specific bit data value of input image data for the plurality of subpixels as a fixed data value, an error calculating unit configured to calculate an error by comparing the fixed data value fixed by the bit selecting unit and the specific bit data value of the input image data before fixed by the bit selecting unit with each other, and a dithering unit configured to generate the output image data dithered to correct the calculated error. The data driving integrated circuit includes a latch unit storing the output image data, a digital analogue converter (DAC) configured to convert the output image data into analogue voltage, and a fixed voltage output unit configured to convert the fixed data value fixed by the bit selecting unit into the analogue voltage and transfer the analogue voltage to each of the plurality of subpixels.

According to another feature of the present disclosure, the input image data may be configured by n+m bits, the output image data may be configured by n bits, the bit selecting unit may be configured to fix a least significant m bit data value of the input image data as the fixed data value, and the fixed voltage output unit may include an m bit resistance string (R-string) configured to convert the fixed data value corresponding to the least significant m bit of the input image data into the analogue voltage.

According to yet another feature of the present disclosure, the timing controller may further include a memory unit configured to store input image data for k-th row subpixels arrayed in a k-th row among the plurality of subpixels, and the bit selecting unit of the timing controller may be configured to determine as the fixed data value for the k-th row subpixels a mode value, a mean value, or an intermediate value of a least significant m bit data value of the input image data for the k-th row subpixels.

According to still yet another feature of the present disclosure, the timing controller may be configured to determine as the fixed data value for the k-th row subpixels a mode value, a mean value, or an intermediate value of a least significant m bit data value of input image data for a specific subpixel selected among the k-th row subpixels arrayed in the k-th row among the plurality of subpixels.

According to still yet another feature of the present disclosure, the dithering unit of the timing controller may be configured by an n bit dithering unit, and the latch unit and the digital analogue converter of the data driving integrated circuit may be configured by an n bit latch unit and an n bit digital analogue converter, respectively.

Although the embodiments of the present disclosure have been described in detail with reference to the accompanying drawings, the present disclosure is not limited thereto and may be embodied in many different forms without departing from the technical concept of the present disclosure. Therefore, the embodiments disclosed in the present disclosure are used to not limit but describe the technical spirit of the present disclosure and the scope of the technical spirit of the present disclosure is not limited by the embodiments. Therefore, it should be understood that the aforementioned embodiments are illustrative in terms of all aspects and are not limited. The scope of the present disclosure should be interpreted by the appended claims and it should be analyzed that all technical spirit in the equivalent range thereto is intended to be embraced by the scope of the present disclosure.

What is claimed is:

1. A timing controller comprising:

a bit selecting unit configured to fix an m bit data value of n+m bit input image data for a plurality of subpixels as a fixed data value, where n and m are integers;

an error calculating unit configured to:

calculate an error between the fixed data value fixed by the bit selecting unit and the m bit data value of the input image data before being fixed by the bit selecting unit, and output an error value based on the error; and a dithering unit configured to:

dither n bit input image data of the n+m bit input image data based on the error value to generate dithered n bit output image data to correct the error, and output the dithered n bit output image data and the fixed data value.

2. The timing controller according to claim 1, wherein the bit selecting unit is configured to fix a least significant m bit data value of input image data for k-th row subpixels arrayed in a k-th row among the plurality of subpixels as the fixed data value, where k is an integer.

3. The timing controller according to claim 2, further comprising:

a memory unit configured to store the input image data for the k-th row subpixels arrayed in the k-th row, wherein the bit selecting unit is configured to determine as the fixed data value for the k-th row subpixels a mode value, an intermediate value, or a mean value of the m bit data value of the input image data for the k-th row subpixels stored in the memory unit.

4. The timing controller according to claim 3, wherein the bit selecting unit is configured to determine a minimum error value in which the error from the m bit data value of the input image data for the k-th row subpixel becomes minimum as the fixed data value for the k-th row subpixel.

5. The timing controller according to claim 2, wherein the bit selecting unit is configured to determine the fixed data value for the k-th row subpixel based on an m bit data value of input image data for a specific subpixel selected among the k-th row subpixels arrayed in the k-th row.

6. The timing controller according to claim 2, wherein the bit selecting unit is configured to determine the fixed data value for (k+1)-th row subpixels arrayed in a (k+1)-th row based on the m bit data value of the input image data for the k-th row subpixels arrayed in the k-th row.

7. The timing controller according to claim 2, wherein the bit selecting unit is configured to determine the fixed data value for the k-th row subpixels based on the m bit data values of the input image data for the k-th row subpixels arrayed in the k-th row and determine the fixed data value for the (k+1)-th row subpixels arrayed in the (k+1)-th row by rolling the fixed data value for the k-th row subpixels.

8. The timing controller according to claim 1, wherein the error calculating unit is configured to calculate a difference value between the m bit data value of the input image data before being fixed by the bit selecting unit and the fixed data value fixed by the bit selecting unit as the error.

9. The timing controller according to claim 8, wherein the dithering unit is configured to dither the n bit input image data and output the dithered n bit output image data so that the error has a positive value when the error has a negative value.

10. A display device comprising:

a display panel including a plurality of subpixels;

a data driving integrated circuit connected with the plurality of subpixels; and a timing controller configured to transmit output image data to the data driving integrated circuit, wherein the timing controller includes:

a bit selecting unit configured to fix a specific bit data value of input image data for the plurality of subpixels as a fixed data value, an error calculating unit configured to:

calculate an error by comparing the fixed data value fixed by the bit selecting unit and the specific bit data value of the input image data before with each other before being fixed by the bit selecting unit, and output an error value based on the error, and a dithering unit configured to:

dither part of the input image data based on the error value to generate dithered output image data to correct the error, and output the dithered output image data and the fixed data value, and wherein the data driving integrated circuit includes:

a latch unit configured to store the dithered output image data, a digital analog converter (DAC) configured to convert the dithered output image data into analog voltage, and a fixed voltage output unit configured to convert the fixed data value fixed by the bit selecting unit into an analog fixed voltage and transfer the analog fixed voltage to each of the plurality of subpixels.

11. The display device according to claim 10, wherein the input image data is configured by n+m bits, where n and m are integers, the output image data is configured by n bits, the bit selecting unit is configured to fix a least significant m bit data value of the input image data as the fixed data value, and the fixed voltage output unit includes an m bit resistance string (R-string) configured to convert the fixed data value corresponding to the least significant m bit of the input image data into the fixed analog voltage.

12. The display device according to claim 11, wherein the timing controller further includes a memory unit configured to store input image data for k-th row subpixels arrayed in a k-th row among the plurality of subpixels, where k is an integer, and the bit selecting unit of the timing controller is configured to determine as the fixed data value for the k-th row subpixels a mode value, a mean value, or an intermediate value of a least significant m bit data value of the input image data for the k-th row subpixels.

13. The display device according to claim 11, wherein the timing controller is configured to determine as the fixed data value for the k-th row subpixels a mode value, a mean value, or an intermediate value of a least significant m bit data value of input image data for a specific subpixel selected among the k-th row subpixels arrayed in the k-th row among the plurality of subpixels.

14. The display device according to claim 11, wherein the dithering unit of the timing controller is configured by an n bit dithering unit, and the latch unit and the digital analog converter of the data driving integrated circuit are configured by an n bit latch unit and an n bit digital analog converter, respectively.

15. A display device comprising:

a display panel including a plurality of subpixels;

a data driving integrated circuit connected with the plurality of subpixels; and a timing controller configured to transmit output image data to the data driving integrated circuit, wherein the timing controller includes:

a bit selecting unit configured to fix a specific bit data value of input image data for the plurality of subpixels as a fixed data value, an error calculating unit configured to calculate an error by comparing the fixed data value fixed by the bit selecting unit and the specific bit data value of the input image data before fixed by the bit selecting unit with each other, and a dithering unit configured to generate the output image data dithered to correct the calculated error, and wherein the data driving integrated circuit includes:

a latch unit storing the output image data, a digital analog converter (DAC) configured to convert the output image data into analog voltage, and a fixed voltage output unit configured to convert the fixed data value fixed by the bit selecting unit into the analog voltage and transfer the analog voltage to each of the plurality of subpixels, and wherein the input image data is configured by n+m bits, where n and m are integers, the output image data is configured by n bits, the bit selecting unit is configured to fix a least significant m bit data value of the input image data as the fixed data value, and the fixed voltage output unit includes an m bit resistance string (R-string) configured to convert the fixed data value corresponding to the least significant m bit of the input image data into the analog voltage.

* * * * *